United States Patent [19]

Thies, Jr.

[11] 3,971,125

[45] July 27, 1976

[54] METHOD OF MAKING AN ANTENNA ARRAY USING PRINTED CIRCUIT TECHNIQUES

[75] Inventor: Wilbur H. Thies, Jr., Santa Barbara, Calif.

[73] Assignee: Raytheon Company, Lexington, Mass.

[22] Filed: Mar. 3, 1975

[21] Appl. No.: 554,390

[52] U.S. Cl. ..... 29/601; 343/769; 343/854

[51] Int. Cl.[2] ..... H01Q 1/38; H01Q 13/10

[58] Field of Search ..... 343/769, 814, 846, 854; 29/601

[56] References Cited

UNITED STATES PATENTS

| | | | |
|---|---|---|---|
| 3,573,831 | 4/1971 | Forbes | 343/846 |
| 3,665,480 | 5/1972 | Fassett | 343/769 |
| 3,803,623 | 4/1974 | Charlot | 343/846 |
| 3,811,128 | 5/1974 | Munson | 343/846 |

*Primary Examiner*—Eli Lieberman
*Attorney, Agent, or Firm*—Richard M. Sharkansky; Philip J. McFarland; Joseph D. Pannone

[57] ABSTRACT

Radio frequency array antenna structures and methods for fabricating such structures are disclosed wherein a plurality of radio frequency circuits forming the radiating face of an array antenna and a corporate feed are formed on one or more relatively flexible dielectric sheets and then bonded to a suitable core material to form a complete array structure which is light weight, inexpensive and structurally sound.

1 Claim, 11 Drawing Figures

METHOD OF MAKING AN ANTENNA ARRAY USING PRINTED CIRCUIT TECHNIQUES

The invention herein described was made in the course of or under a contract or subcontract thereunder, with the Department of Defense.

BACKGROUND AND SUMMARY OF THE INVENTION

This invention relates generally to radio frequency array antenna structures and methods for fabricating such structures.

As is known in the art, it is generally highly desirable to provide light weight inexpensively fabricated radio frequency array antenna structures. According to this invention such an array antenna structure is provided by forming, on one or more relatively flexible dielectric sheets, a plurality of radio frequency circuits comprising a radiating array face of an array antenna and feed networks and then bonding such dielectric sheet (or sheets) to a suitable core material to form a complete array antenna structure which is light in weight, is inexpensive to fabricate and is structurally sound.

In one embodiment a planar array antenna is fabricated by using two dielectric sheets. One of such dielectric sheets has a conductive ground plane formed on one side and a plurality of corporate feed networks formed on the other side; the other one of such dielectric sheets has a plurality of annular slots etched from a ground plane formed on one side thereof. The two dielectric sheets are bonded together to form a stripline structure with the corporate feed networks on the one and annular slots on the other being in registry to form the radiating elements of the desired array antenna. The bonded dielectric sheets are then bonded to at least one stiffener (or core) to provide the desired completed array antenna.

In a second embodiment a conformal array is formed by arranging a plurality of array modules side-by-side around a predetermined conformal surface. Each one of the array modules includes a flexible dielectric sheet (or substrate) having simultaneously formed thereon circuitry which comprises an array of radiating elements, a ground plane for such elements, a corporate feed network and a portion of a parallel plate lens coupled to the feed network. The dielectric substrate with the circuitry formed thereon is folded around, and bonded to, a suitably shaped core to provide structural integrity to each array module.

DESCRIPTION OF THE PREFERRED EMBODIMENTS

Figure 1:
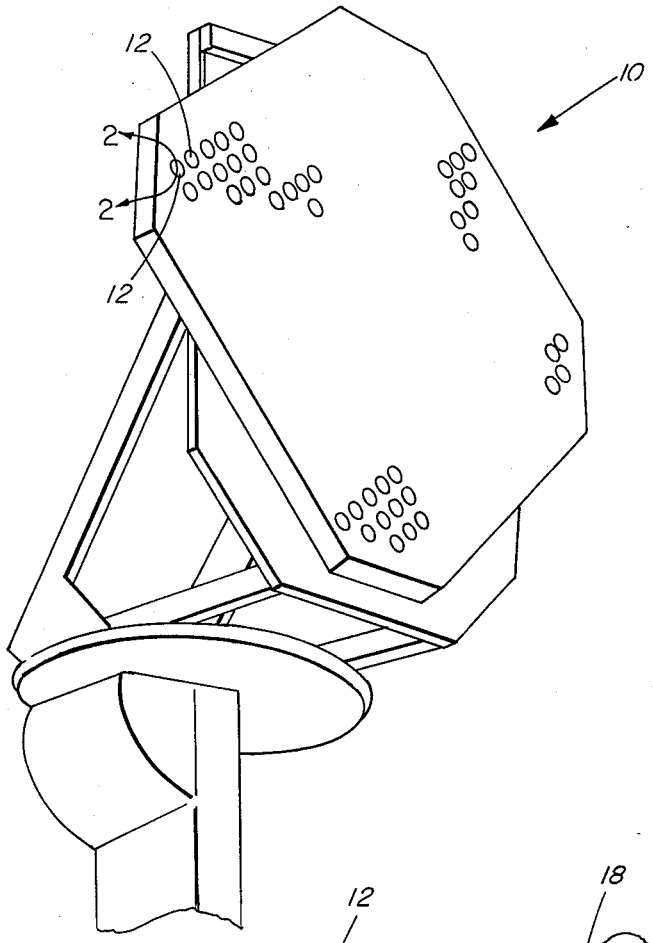
FIG. 1 is a flat planar array antenna according to the invention.
Figure 2:
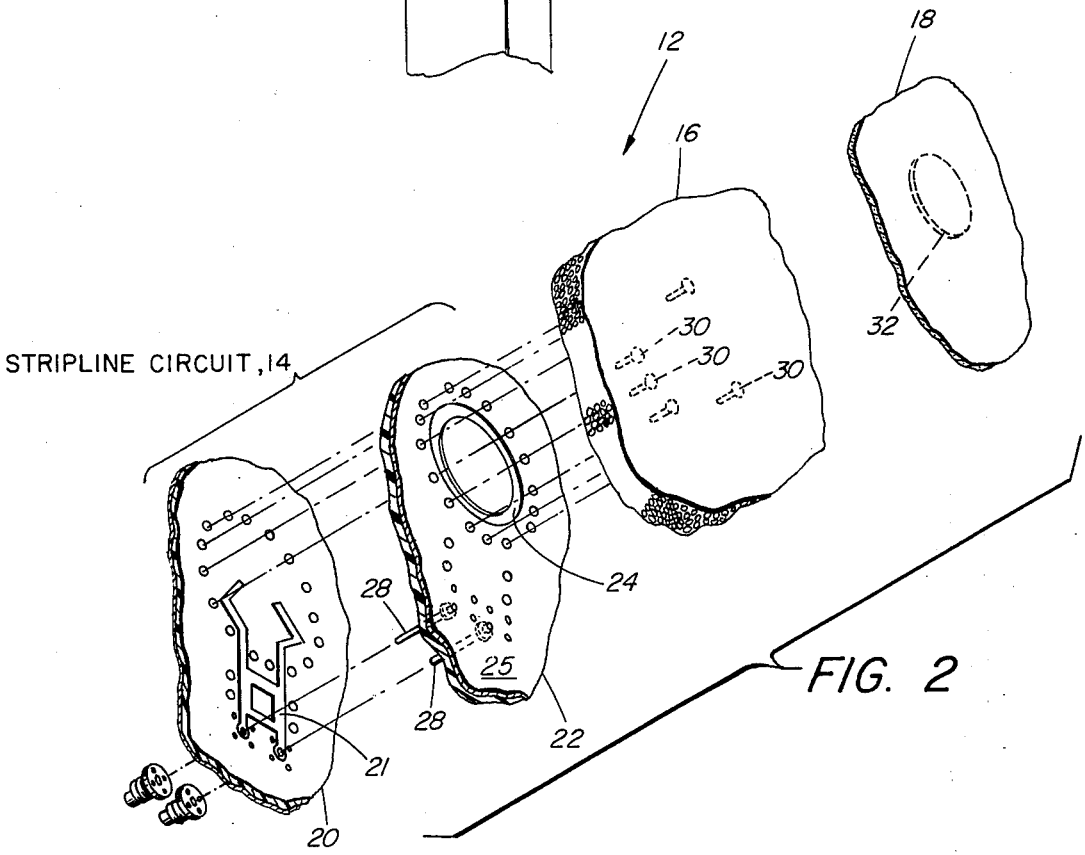
FIG. 2 is an exploded view of an exemplary one of the radiating elements of the antenna shown in FIG. 1.

Referring now to FIG. 1, a flat planar array antenna 10 is shown to include a plurality of identical radiating elements 12. An exemplary one of such radiating elements is shown in FIG. 2 and is of the type described in U.S. Pat. No. 3,665,480 issued May 23, 1972, Inventor M. Fassett, and assigned to the same assignee as the present invention. Such radiating element 12 includes: A stripline circuit 14; a core structure 16, here polyurethane structural foam; and, a radome board 18, here a panel of epoxy fiberglass board.

Figure 4:
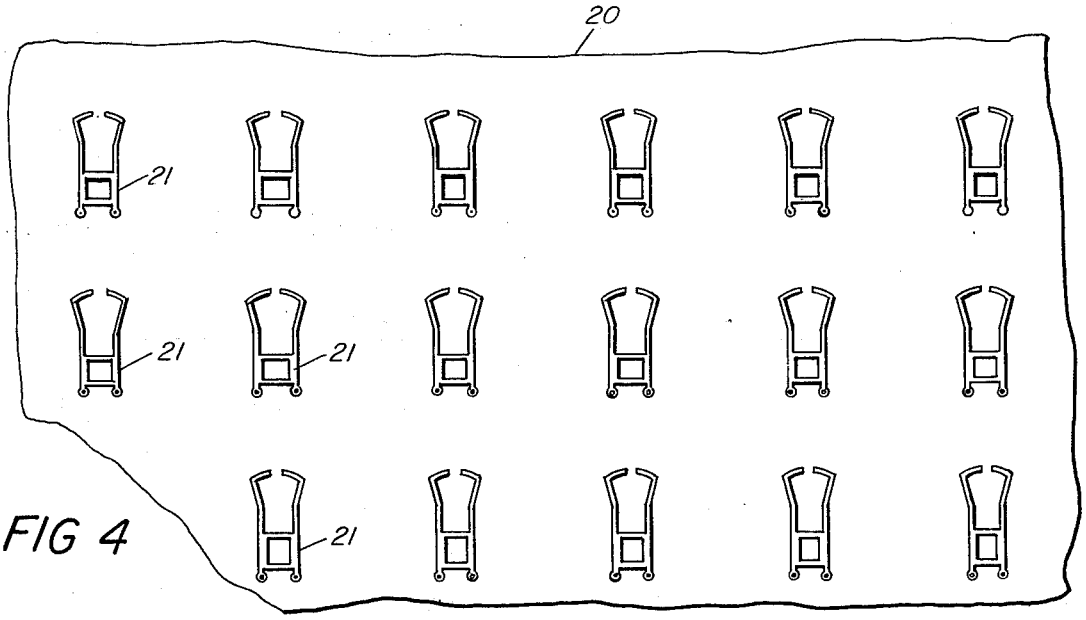
FIGS. 3–5 are planar views of portions of panels used to form the radiating elements, an exemplary one thereof being shown in FIG. 2.
Figure 3:
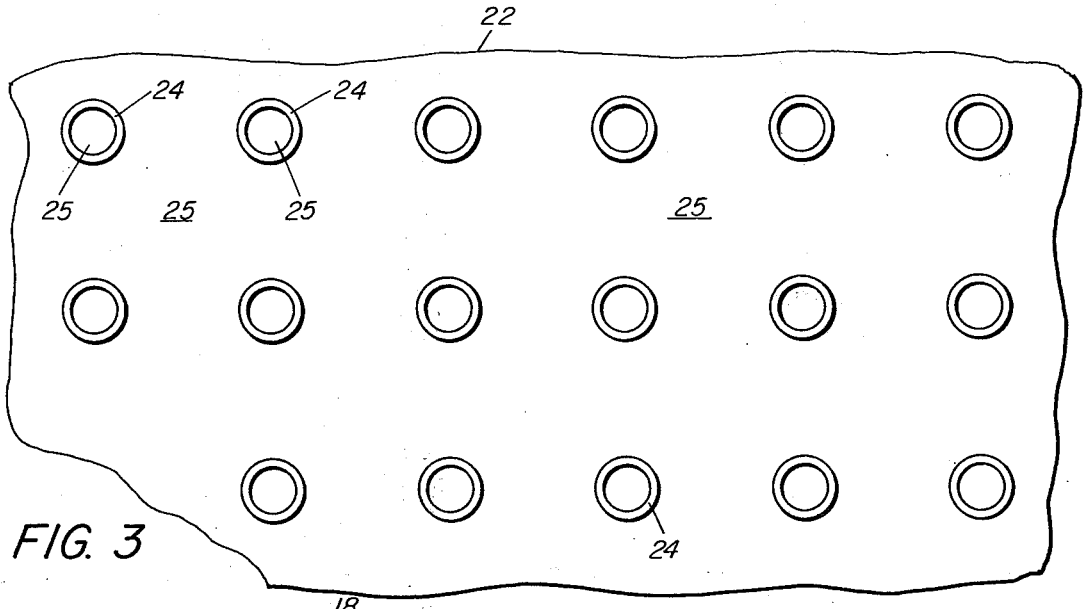

The stripline circuit 14 includes two teflon fiberglass stripline sheets, 20, 22. Sheet 22, shown partially in FIG. 3, has a plurality of annular slots 24 etched from copper cladding 25 on one surface (which also forms one ground plane of the stripline circuit). Each one of such slots 24 provides an aperture for a corresponding one of the radiating elements 12 as described in the referenced U.S. Pat. No. 3,665,480. Sheet 20 is partially shown in FIG. 4. Such sheet 20 is initially clad on both sides with copper and then copper on one side is etched to form a plurality of feed networks 21 for the radiating elements. The feed networks 21 on sheet 20 and the circular slots 24 on sheet 22 are held in proper registry using any conventional alignment procedure, and then press bonded in a conventional manner to form a stripline circuit panel. The feed networks 21 then are the center conductor circuits of the stripline circuit 14. Radio frequency conductors 28 and mode suppression eyelets 30 are installed after bonding of the stripline panel in any conventional manner thereby completing fabricating of the stripline circuit 14. It is here noted that the plurality of feed networks 21 is formed simultaneously on the sheet 20 and likewise the radiating element apertures 21 are formed simultaneously on the sheet 22.

Figure 5:
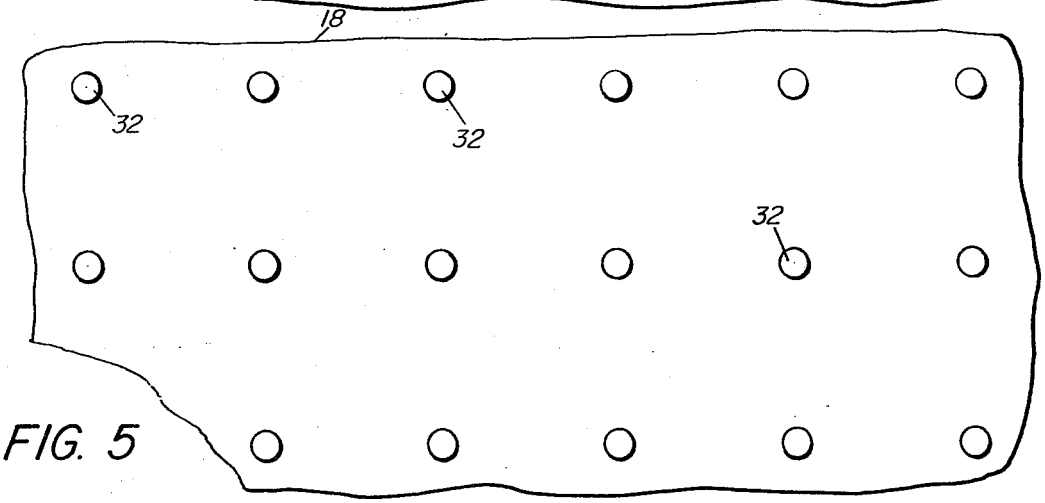

Radome board 18 shown partially in FIG. 5 has a plurality of copper disks 32 having a diameter equal to the inner diameter of the annular slot 24 formed thereon by the conventional etching process discussed above. The copper disks are aligned coaxially with corresponding annular slots 24 using any conventional alignment procedure. Then the stripline circuit 14, core structure 16 and radome board 18 are bonded together to form a laminated structure.

Figure 6:
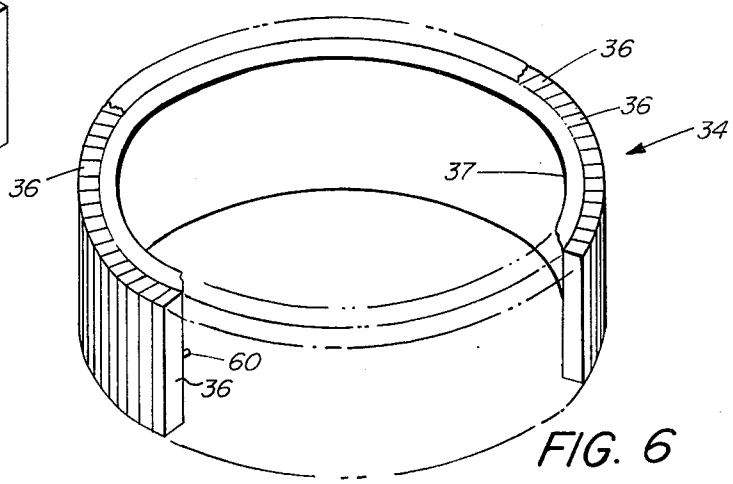
FIG. 6 is a conformal array antenna according to the invention.

Referring now to FIG. 6 a cylindrical array antenna 34 capable of a 360° scan is shown. Such array antenna 34 here is an L-band design 38 feet in diameter and 8 feet high. The face of the array antenna 34 is made up of a plurality of identical array modules 36, here 192 in number, each one bonded in a convenient manner around the periphery of a cylindrical mount 37.

Figure 7:
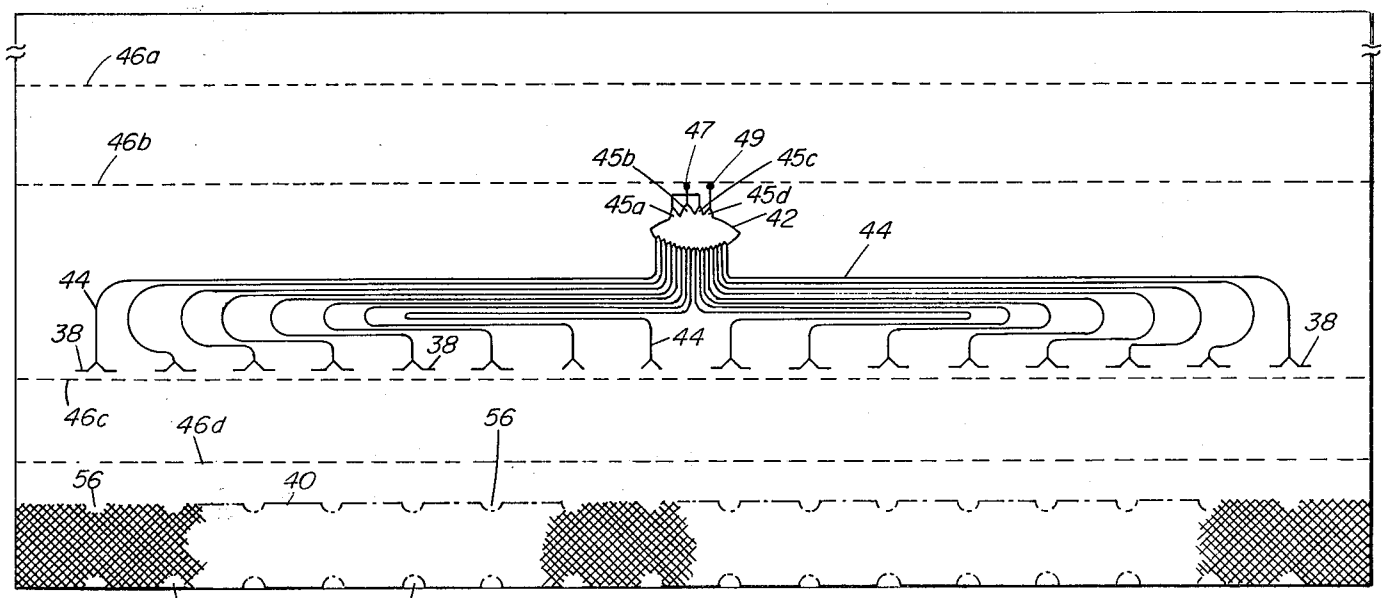
FIG. 7 is a layout of a sheet used in forming an array module of the antenna shown in FIG. 6.
Figure 9:
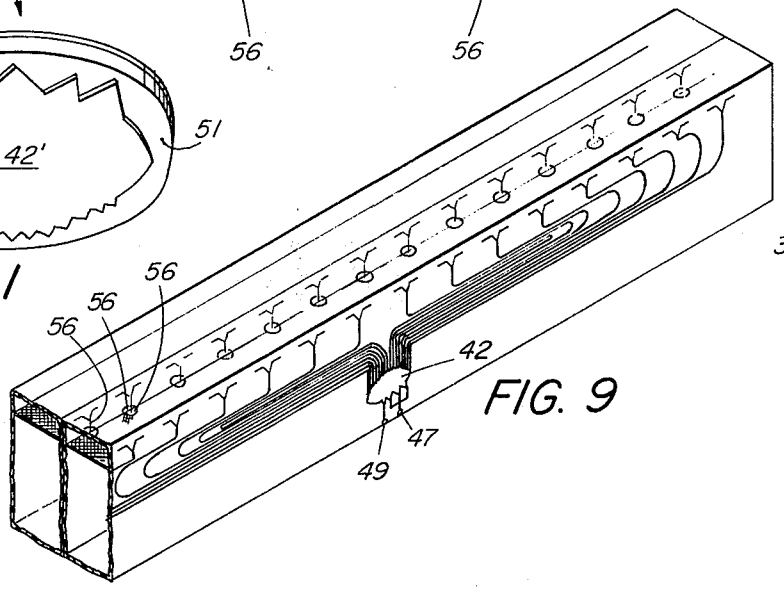
FIG. 9 is a perspective view of two adjacent array modules having blocks of core material removed.
Figure 11:
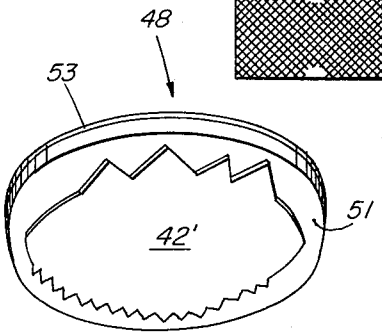
FIG. 11 is a perspective view of an oval-shaped assembly used in the array module.
Figure 8:
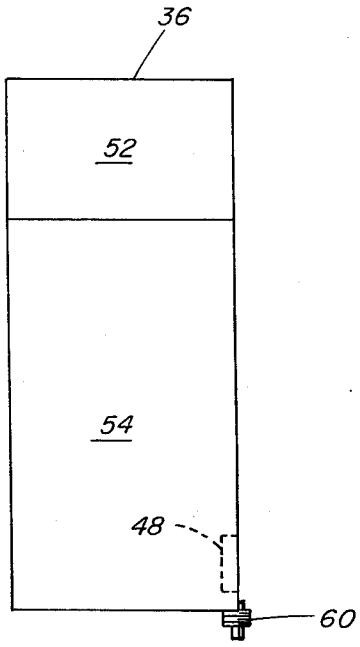
FIG. 8 is an end view of one of the array modules of the antenna shown in FIG. 6.

Each one of the modules 36 is constructed by etching, simultaneously, in a single etching process on a thin copper clad sheet of flexible substrate, here Mylar, measuring approximately 36 inches wide and 96 inches long, 16 half-wave dipole radiating elements 38, a ground plane 40, a strip section 42 of a constrained lens of the type described in U.S. Pat. No. 3,761,936, "Multi-Beam Array Antenna", D. H. Archer, R. J. Prickett and C. P. Hartwig, inventors, issued Sept. 25, 1973 and assigned to the same assignee as the present invention, and RF transmission lines 44 (here conventional twin lines but indicated by single lines) as shown in FIG. 7. Here such strip section 42 has four input ports 45*a*, 45*b*, 45*c*, 45*d*, with input ports 45*a*, 45*b* and 45*c* interconnected during the etching process. Further, feed ports 47, 49 are also formed during the etching process, feed port 47 being connected to output ports 45*a*, 45*b* and 45*c*, as shown, feed port 49 being connected to output port 45*d*, as shown. A generally oval-shaped assembly 48 (shown in FIG. 11 to include a dielectric material 51 with a copper ground plane 53 formed on one side thereof and a duplicate 42′ of the strip section 42 formed on the other side thereof) serves as the constrained lens described by Archer et al. The duplicate strip section 42′ is affixed with a suitable conductive epoxy to the strip section 42 formed on the Mylar substrate so that the ground plane 53 serves as the ground plane for the strip section 42 and the duplicate strip section 42′. The Mylar sheet forming the array module 36 (together with the affixed oval-shaped assembly 48) is then wrapped around and bonded to two blocks of core material, 52, 54 (FIG. 8), here polystyrene foam, to provide structural integrity to the module. The block 54 may have a groove formed in the bottom to provide space for the oval-shaped device 48. Referring again to FIG. 9, a pair of adjacent array modules 36 are shown with the two blocks of core material 52, 54 removed. From FIG. 9 it is evident that, because adjacent ones of the ground planes 40 have 16 mating semicircular shaped grooves 56, the Mylar dielectric material of adjacent modules electrically insulate RF transmission lines 44 from the ground plane 40.

Each array module 36, then, may be considered to be a linear array having the 16 dipole elements 38, a conductive ground plane 40 disposed behind the elements 38, an RF microstrip lens for elevation beam forming, and RF transmission lines 44 to interconnect the dipole elements 38 and the lens. The 16 grooves 56 on the lower side of the ground plane are provided to enable electrical isolation between the RF transmission lines 44 of one array module 36 and the ground plane 40 of the adjacent array module 36 as discussed and shown in FIG. 9. Because of the small spacing (intervals of wavelengths) between the individual ground planes 40, such ground planes act as one continuous ground plane for the cylindrical conformal array 34 when the array modules 36 are mounted adjacent one another to form such cylindrical array 34 (FIG. 6).

Figure 10:
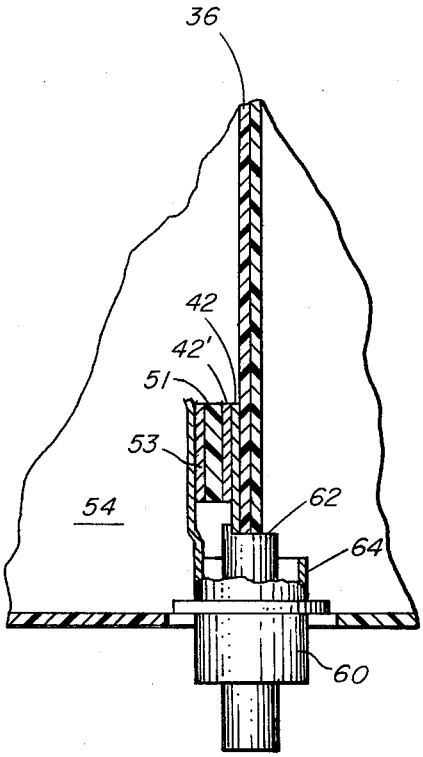
FIG. 10 is a fragmented view, partially in cross-section, showing the interconnection between a coaxial connector and a feed port for the array module.

Completing the exemplary array module 36 after the sheet is bonded to the two blocks 52, 54 of core material, the ends of the module are sealed with caps (not shown) here of Mylar, to produce a sealed module. Referring now to FIG. 10 a coaxial connector fitting 60 is shown having its center conductor 62 in electrical contact with the strip section 42 and the duplicate strip section 42′ and the outer conductor 64 in electrical contact with the ground plane 53. The coaxial connector fitting 60 is bonded to the block 54 using any suitable epoxy.

Although preferred embodiments of the invention have been described in detail, it is to be understood that various changes, substitutions and alterations can be made therein without departing from the spirit and scope of the appended claim.

What is claimed is:

1. The method of forming a conformal array antenna comprising the steps of:

a. forming a plurality of array modules, each one being formed by:
   i. etching simultaneously on one surface of a flexible dielectric sheet, an array of radiating elements, a ground plane for such elements, a corporate feed network for such elements and a portion of a parallel plate lens coupled to the feed network;
   ii. folding such dielectric sheet around a stiffener including: disposing the plurality of radiating elements in a first plane, and, positioning the ground plane behind the radiating elements in a plane orthogonal to the first plane; and
   iii. bonding such folded dielectric sheet to such stiffener; and b. arranging the plurality of array modules around a predetermined conformal surface.

* * * * *